US005128237A

United States Patent [19]

Kimura et al.

[11] Patent Number: 5,128,237

[45] Date of Patent: Jul. 7, 1992

[54] DIRECT POSITIVE SILVER HALIDE PHOTOGRAPHIC MATERIAL

[75] Inventors: Nariko Kimura; Tomomi Yoshizawa; Shigeto Hirabayashi; Toyoaki Masukawa, all of Hino, Japan

[73] Assignee: Konica Corporation, Tokyo, Japan

[21] Appl. No.: 665,933

[22] Filed: Mar. 5, 1991

Related U.S. Application Data

[63] Continuation of Ser. No. 482,179, Feb. 20, 1990, abandoned.

[30] Foreign Application Priority Data

Feb. 17, 1989 [JP] Japan ..... 1-39027

[51] Int. Cl.[5] ..... G03C 5/305; G03C 1/34

[52] U.S. Cl. ..... 430/378; 430/467; 430/484; 430/485; 430/505; 430/547; 430/551; 430/957

[58] Field of Search ..... 430/505, 547, 551, 957, 430/467, 484, 485, 490, 378

[56] References Cited

U.S. PATENT DOCUMENTS 4,741,994 5/1988 Ichijima et al. ..... 430/549
4,818,668 4/1989 Ichijima et al. ..... 430/505
4,977,073 12/1990 Ishige et al. ..... 430/549

FOREIGN PATENT DOCUMENTS 297836 1/1989 European Pat. Off. ..... 430/547

*Primary Examiner*—Charles L. Bowers, Jr.
*Assistant Examiner*—Janet C. Baxter
*Attorney, Agent, or Firm*—Jordan B. Bierman

[57] ABSTRACT

Significant improvement in color reproduction can be achieved by a direct positive silver halide color photographic material having at least one each of a blue-sensitive, green-sensitive and a red-sensitive direct positive silver halide emulsion layer, in which material at least one of said direct positive silver halide emulsion layer contains both silver chloride or a silver halide composed of silver chlorobromide or silver chloroiodobromide containing no less than 50 mol % of AgCl, and a specific compound that is capable of reacting with the oxidation product of a developing agent to release a specific compound capable of scavenging said oxidation product or a precursor of said scavenging compound.

21 Claims, 1 Drawing Sheet

DIRECT POSITIVE SILVER HALIDE PHOTOGRAPHIC MATERIAL

This application is a continuation of application Ser. No. 07/482,179, filed Feb. 20, 1990, now abandoned.

BACKGROUND OF THE INVENTION

The present invention relates to a direct positive silver halide photographic material, particularly to one having sufficient color reproduction quality to be advantageously used for color copying purposes.

In forming color photographic image by the subtractive process, yellow, magenta and cyan couplers are commonly used. The spectral absorptions of the resulting dye images are such that the magenta dye image has an unwanted absorption at 400–500 nm and 600–700 nm in addition to the main absorption, and the cyan dye image has such an unwanted absorption at 400–600 nm. These unwanted absorption cause color contamination which reduces the saturation of color images. Color photographs with reduced saturation do not have high commercial value, particularly in the case of reproducing graphic arts. In order to solve this problem, masking techniques such as by the use of colored couplers has heretofore been employed to compensate for unwanted absorptions in negative working light-sensitive materials. However, colored couplers are not suitable for use in positive working light-sensitive materials such as reversal materials and color papers since they produce increased minimum densities.

The use of compounds that are capable of reacting with the oxidation product of developing agents to release diffusible development restrainers or precursors thereof (such compounds are hereinafter referred to as "DIR compounds") is known as a technique for inhibiting the formation of colors in layers other than the one of interest which corresponds to the unwanted absorption.

Various versions of this technique are disclosed in U.S. Pat. No. 4,477,563, etc. However, if such DIR compounds are used in internal latent image forming direct positive light-sensitive materials, the released development restrainers are not sufficiently effective to inhibit the formation of colors in other layers by a satisfactory degree.

It is also known to incorporate compounds (DSR compounds) that are capable of reacting with the oxidation product of developing agents to release compounds capable of scavenging said oxidation product or precursors of such compounds, so that the layer containing such DSR compounds can be developed while a development restrainer acts on other layers. A problem also occurs when DSR compounds are used in internal latent image forming direct positive light-sensitive materials. In order to insure that the layer containing such DSR compounds can be developed without causing unwanted development of other layers, the DSR compounds have to be used in increased amounts but then there occurs not only a change in image color (as indicated by λs in FIG. 1) but also deterioration in the pot life of coating solutions (i.e., the stability of coating solutions after preparation, which is hereunder referred to simply as "digestion stability").

Therefore, a method has been desired that can be applied to internal latent image forming direct positive light-sensitive materials and by which the occurrence of color development in layers other than the one being developed can be restrained as a function of color formation in the latter without causing any change in image color or reduction in the digestion stability of coating solutions.

SUMMARY OF THE INVENTION

The present invention has been accomplished under these circumstances. A first object of the invention is to provide a direct positive silver halide color photographic material that need only use a small amount of DSR compound and which yet is capable of effective development restrainment to achieve a substantial improvement in color reproduction. A second object of the present invention is to provide a direct positive silver halide color photographic material that has a composition for emulsion layers that does not cause any change in image color and which has satisfactory digestion stability of coating solutions.

These objects of the present invention can be attained by a direct positive silver halide color photographic material having at least one each of a blue-sensitive, green-sensitive and a red-sensitive direct positive silver halide emulsion layer, in which material at least one of said direct positive silver halide emulsion layers contains both silver chloride or a silver halide composed of silver chlorobromide or silver chloroiodobromide containing no less than 50 mol% of AgCl, and a compound represented by the following general formula (I):

$$\text{Coup}-(\text{Time})l-\text{Sc} \qquad \text{(I)}$$

where Coup is a coupler residue capable of releasing (Time)l−Sc upon reaction with the oxidation product of a color developing agent; Time is a timing group capable of releasing Sc after Time−Sc is released from Coup; Sc is a scavenger of the oxidation product of the color developing agent which is capable of scavenging said oxidation product by a redox reaction or a coupling reaction; and l is 0 or 1.

DETAILED DESCRIPTION OF THE INVENTION

Figure 1:
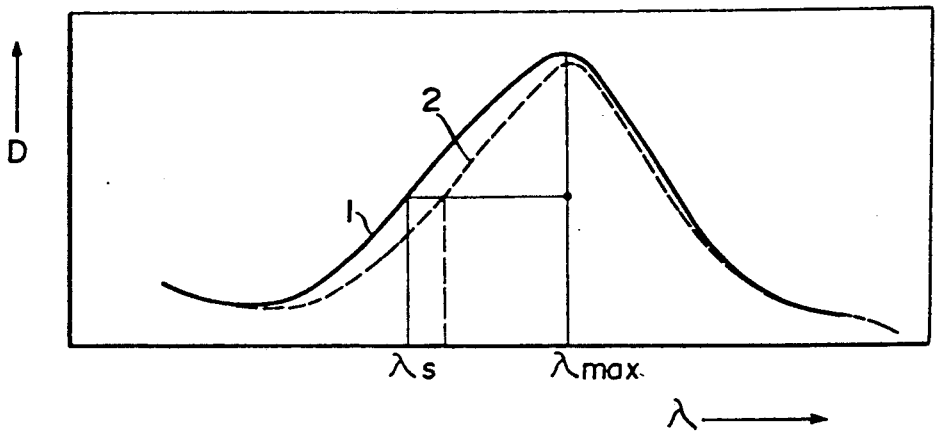
FIG. 1 is a graph showing reflection spectral absorption curves for two cases, one for the absence of a DSR compound and the other for the incorporation of a DSR compound.

The DSR compound of the general formula (I) which is capable of reacting with the oxidation product of a developing agent to release a compound capable of scavenging said oxidation product or a precursor of such a compound is first described below.

In the general formula (I), the coupler residue represented by Coup is generally a yellow coupler residue, a magenta coupler residue, a cyan coupler residue or a coupler residue that is substantially incapable of forming an image forming color dye, and preferred examples are represented by the following general formulas (Ia) to (Ih):

$$R_1COCHCONHR_2 \qquad \text{(Ia)}$$
$$\quad\;\; |$$

-continued (Ib)

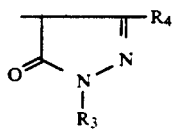

(Ic)

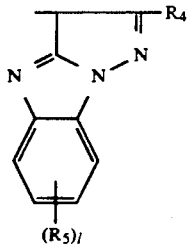

(Id)

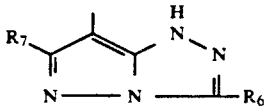

(Ie)

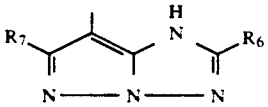

(If)

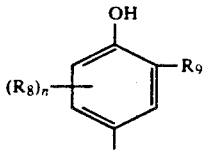

(Ig)

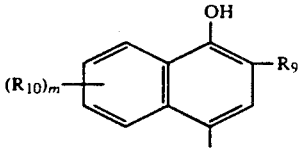

(Ih)

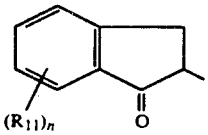

In the general formula (Ia), $R_1$ represents an alkyl, aryl or arylamino group, and $R_2$ represents an aryl or alkyl group.

In the general formula (Ib), $R_3$ represents an alkyl or aryl group, and $R_4$ represents an alkyl, acylamino, arylamino, arylureido or alkylureido group.

In the general formula (Ic), $R_4$ has the same meaning as $R_4$ in the general formula (Ib) and $R_5$ represents an acylamino group, a sulfonamide group, an alkyl group, an alkoxy group or a halogen atom.

In the general formulas (Id) and (Ie), $R_7$ represents an alkyl, aryl, acylamino, arylamino, alkoxy, arylureido or alkylurcido group, and $R_6$ represents an alkyl or aryl group.

In the general formula (If), $R_9$ is an acylamino, carbamoy or arylureido group, and $R_8$ represents a halogen atom or an alkyl, alkoxy, acylamino or sulfonamido group.

In the general formula (Ig), $R_9$ has the same meaning as in the general formula (If) and $R_{10}$ represents an amino, carbonylamide, sulfonamido or hydroxyl group.

In the general formula (Ih), $R_{11}$ represents a nitro group, an acylamino group, a succinimido group, a sulfonamido group, an alkoxy group, an alkyl group, a halogen atom or a cyano group.

Symbol l in the general formula (Ic) represents an integer of 0–3; n in the general formulas (If) and (Ih) represents an integer of 0–2; and m in the general formula (Ig) represents an integer of 0 or 1. When l and n are each 2 or more, $R_5$, $R_8$ and $R_{11}$ may be the same or different.

The groups or atoms described above may have substituents and preferred substituents include a halogen atom, a nitro group, a cyano group, a sulfonamido group, a hydroxyl group, a carboxyl group, an alkyl group, an alkoxy group, a carbonyloxy group, an acylamino group, an aryl group, as well as those which contain coupler portions as in "bis" type couplers and polymer couplers.

The oleophilicity of $R_1$–$R_{11}$ in the general formulas (Ia) to (Ih) may be appropriately selected in accordance with object. In the case of ordinary image forming couplers, the sum of carbon atoms in $R_1$–$R_{11}$ is preferably 10–60, more preferably 15–30. If one wants to insure that dyes formed upon color development are capable of moving in the light-sensitive material by a suitable degree, the sum of carbon atoms in $R_1$–$R_{11}$ is preferably not more than 15.

Couplers that are substantially incapable of forming an image forming color dye mean not only couplers that do not form a color dye but also those couplers which will not leave any color image after development such as "releasable dye forming couplers" which allow color dyes to flow out of the light-sensitive material into processing solutions and "bleachable dye forming couplers" which will be bleached upon reacting with components in the processing solutions. In the case of in $R_1$–$R_{11}$ is preferably not more than 15 and it is more preferred that $R_1$–$R_{11}$ have at least one substituent selected from among carboxyl, arylsulfonamido, and alkylsulfonamide groups.

The timing group represented by Time in the general formula (I) is preferably represented by one of the following general formulas (Ii), (Ij) and (Ik):

(Ii)

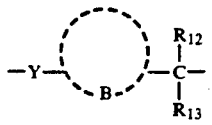

where B is the atomic group necessary to complete a benzene or naphthalene ring; Y represents

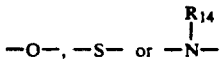

and is bound to the active site of Coup (coupling component) in the general formula (I); $R_{12}$, $R_{13}$ and $R_{14}$ each represents a hydrogen atom, an alkyl group or an aryl group and

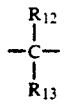

is a group substituted in the position ortho or para to Y and is connected at the other end to Sc in the general formula (I);

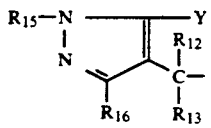

(Ij)

where Y, $R_{12}$ and $R_{13}$ each has the same meaning as in the general formula (Ii); $R_{15}$ is a hydrogen atom, on alkyl group, an aryl group, an acyl group, a sulfonyl group, an alkoxycarbonyl group or a heterocyclic residue; $R_{16}$ is a hydrogen atom, a heterocyclic residue, an alkyl, aryl, alkoxy, amino, acid amido, sulfonamido, carboxyl, alkoxycarbonyl, carbamoyl or cyano group.

As in the general formula (Ii), the timing group in the general formula (Ij) has Y bound to the active site of Coup (coupling component in the general formula (I) and has

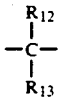

bound to Sc.

The timing group represented by the general formula (Ik) is of a type that releases Sc upon intramolecular nucleophilic substitution reaction:

—Nu—D—E— (Ik)

where Nu represents a nucleophilic group having an electron-rich atom such as an oxygen, sulfur or nitrogen atom and it is bound to the active site of Coup (coupling component) in the general formula (I); E represents an electrophilic group having an electron-deficient group such as a carbonyl, thiocarbonyl, phosphinyl or thiophosphinyl group and it is bound to the hetero atom in Sc; and D represents a bonding group that relates Nu sterically to E and which, after Nu is released from coup (coupling component), undergoes a reaction accompanied by the formation of a 3- to 7-membered ring to destroy the intramolecular nucleophilic substitution, thereby releasing Sc.

The scavenger of the oxidation product of a color developing agent which is represented by Sc is of either a redox type or a coupling type. If Sc in the general formula (I) is capable of scavenging the oxidation product of a color developing agent by a redox reaction, it is a group capable of reducing said oxidation product. Preferred reducing agents are described in such references as Angew. Chem. Int., Ed., 17, 875–886 (1978), The Theory of the Photographic Process, 4th Ed., Macmillan Publishing Company, Chapter 11, and JP-A-59-5247 (the term "JP-A" as used herein means an "unexamined published Japanese application). Precursors capable of releasing these reducing agents during development may also be used. Specific examples of such precursors are aryl and heterocyclic groups having at least two of

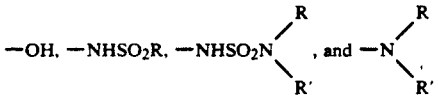

(where R and R' each represents a hydrogen atom or an alkyl, cycloalkyl, alkenyl or aryl group), with an aryl group being preferred. Among aryl groups, a phenyl group is more preferred.

The oleophilicity of Sc may be appropriately selected in accordance with object as in the case of the couplers represented by the general formulas (Ia)–(Ih). In order to maximize the possible advantage of the present invention, the sum of carbon atoms in Sc is generally 6–50, preferably 6–30, more preferably 6–20.

If Sc is of a type that scavenges the oxidation product of a color developing agent by coupling reaction, it may be selected from among various coupler residues but preferably it is a coupler residue that is substantially incapable of forming an image forming color dye. Useful couplers are the above-described releasable dye forming couplers, bleachable dye forming couplers, and Weiss couplers that have a non-leavin substituent at the reactive site and which do not form a dye.

Specific examples of DSR compounds that can be used in the present are described in the following patents: U.S. Pat. Nos. 4,438,193, 4,618,571, 4,741,994, 4,678,743, European Patent No. 0,297,836 and JP-A-61-102646.

Redox type scavengers are preferably used as Sc and in this case, the color developing agent may be cyclically used by reducing its oxidation product.

The following are non-limiting examples of the DSR compound represented by the general formula (I).

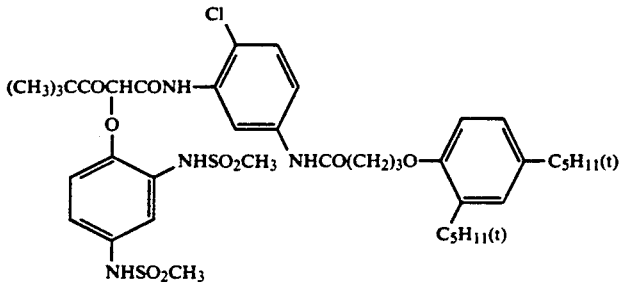

DSR-1

-continued
DSR-2
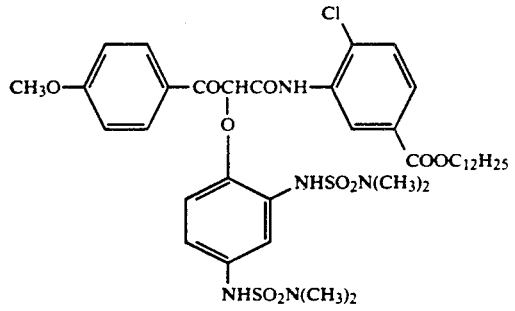
DSR-3
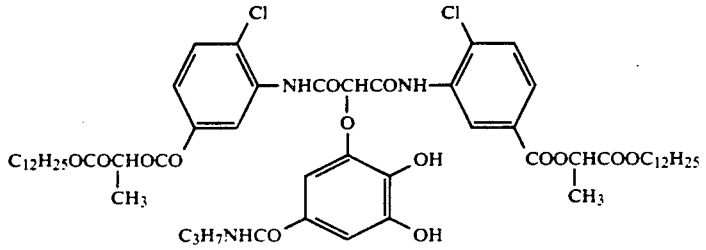
DSR-4
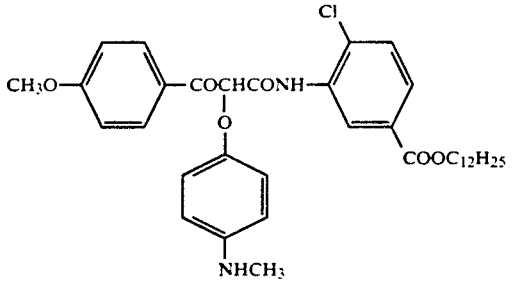
DSR-5
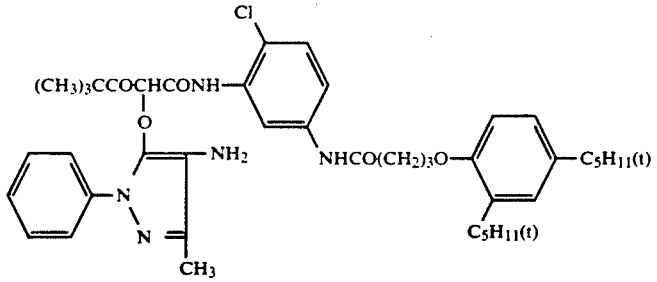
DSR-6
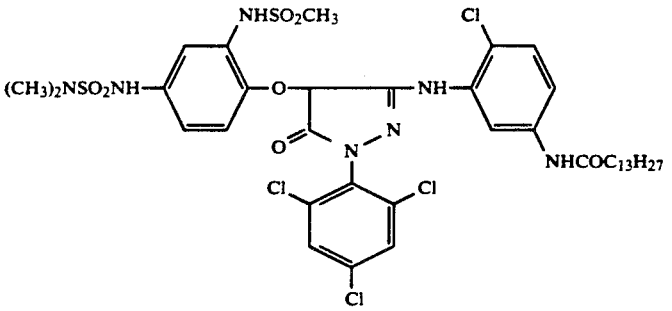

-continued
DSR-7
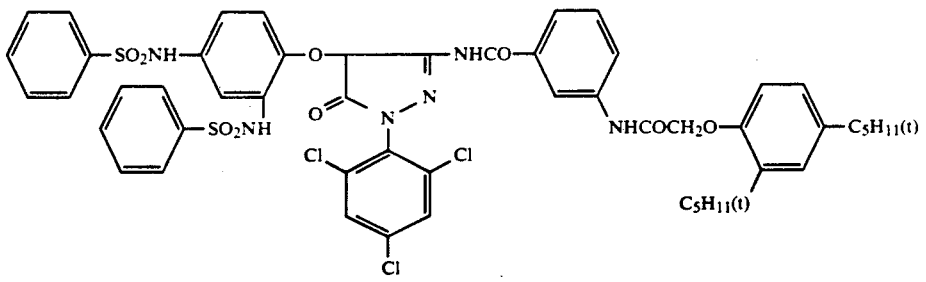
DSR-8
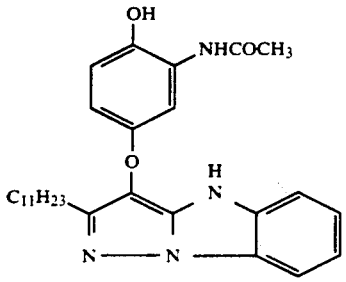
DSR-9
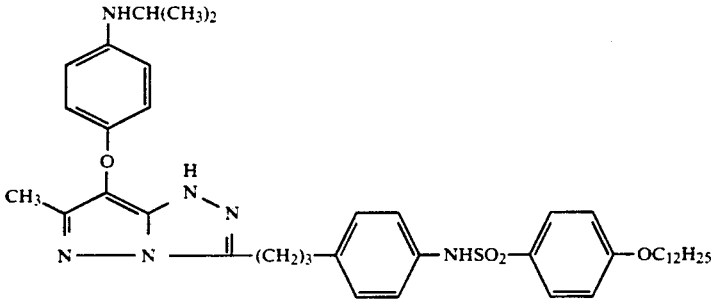
DSR-10
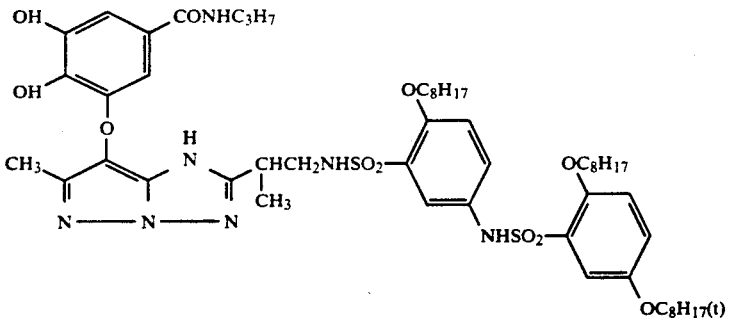
DSR-11
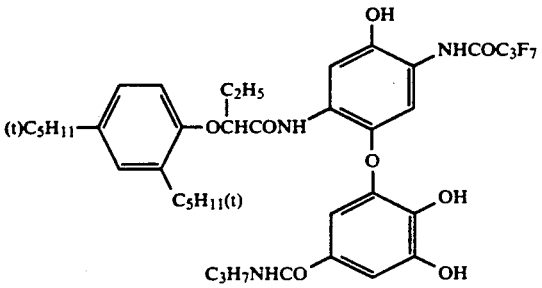

-continued
DSR-12
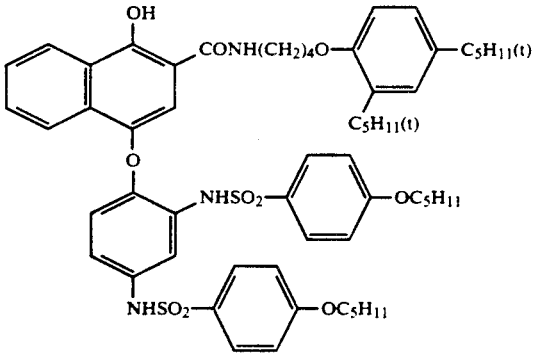
DSR-13
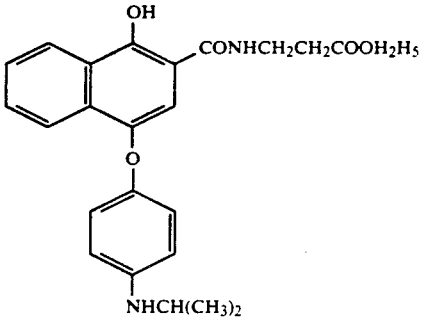
DSR-14
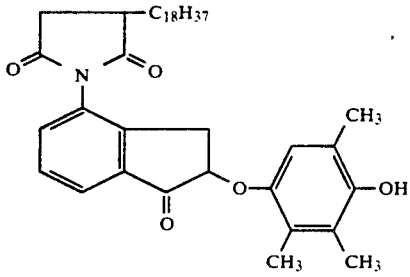
DSR-15
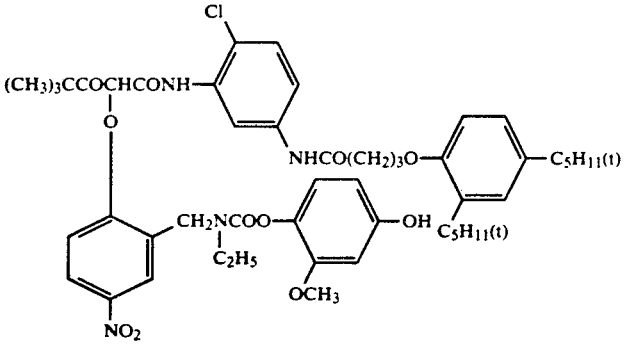
DSR-16
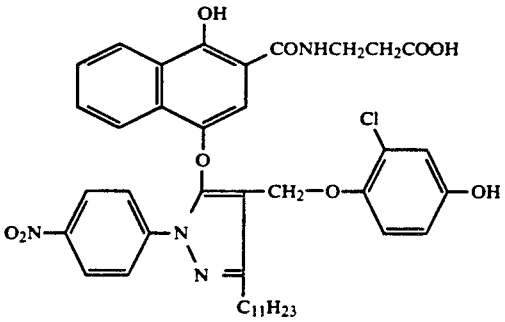

-continued
DSR-17
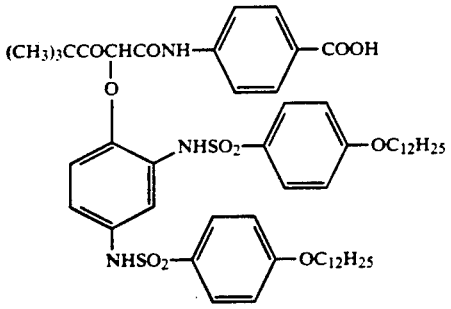
DSR-18
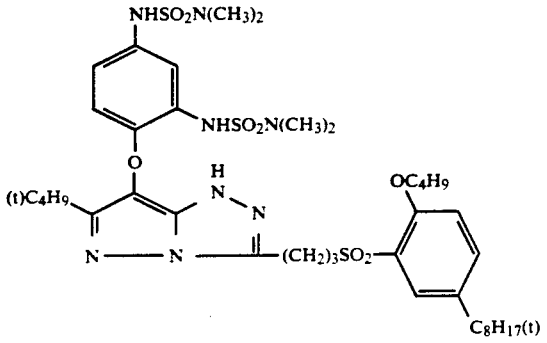
DSR-19
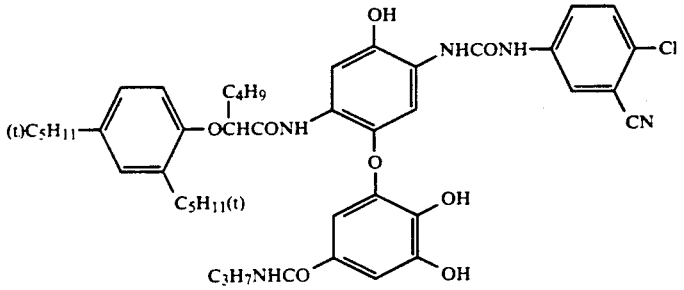
DSR-20
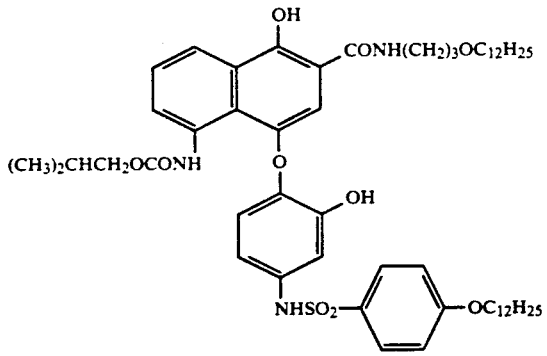
DSR-21
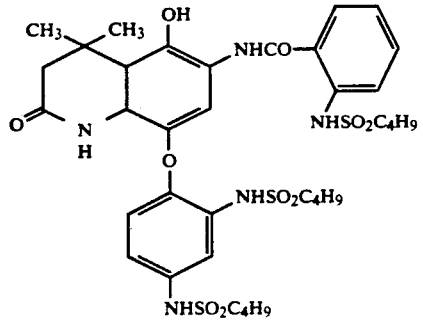

-continued
DSR-22
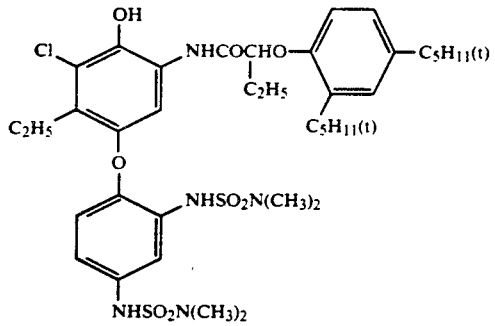
DSR-23
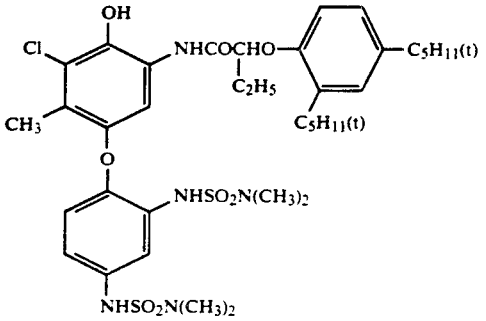
DSR-24
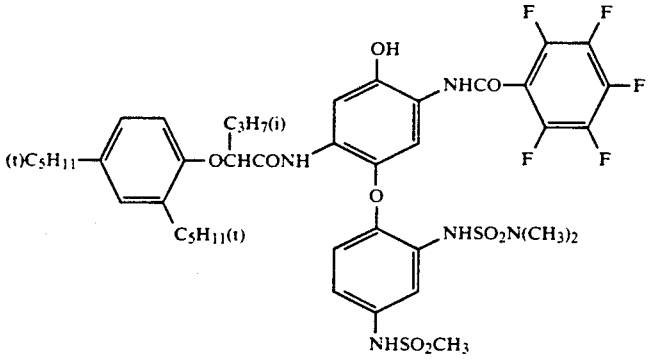
DSR-25
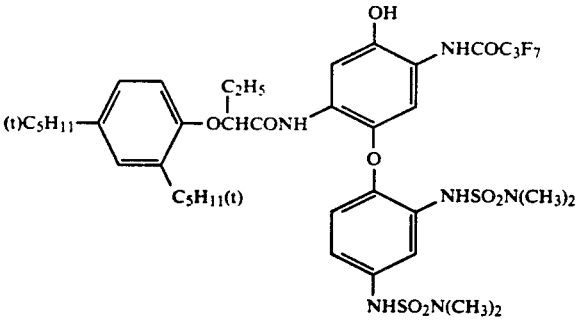
DSR-26
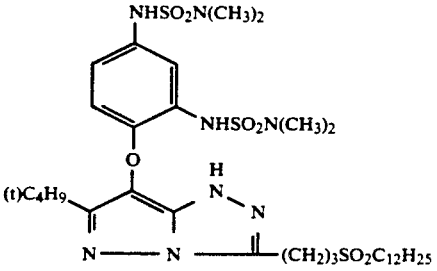

-continued
DSR-27
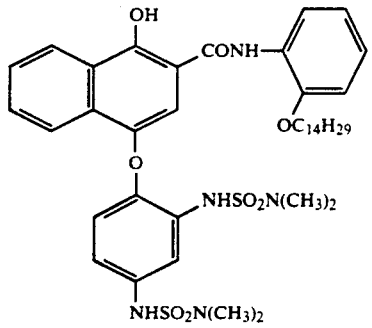
DSR-28
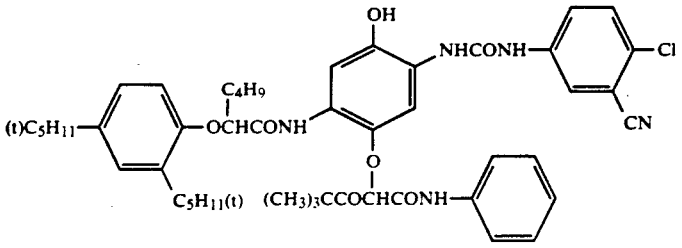
DSR-29
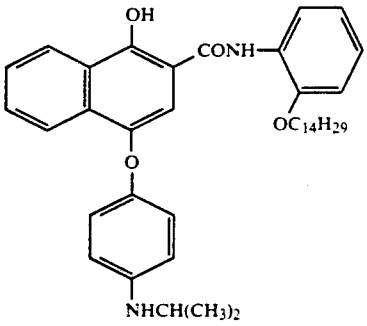
DSR-30
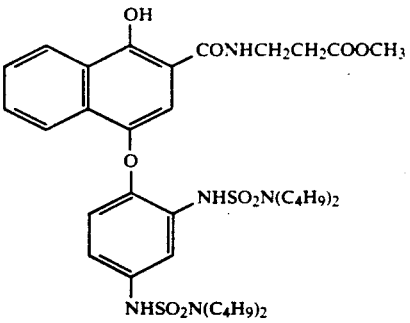
DSR-31
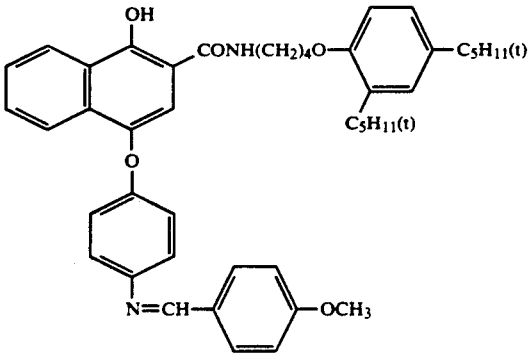

-continued
DSR-32
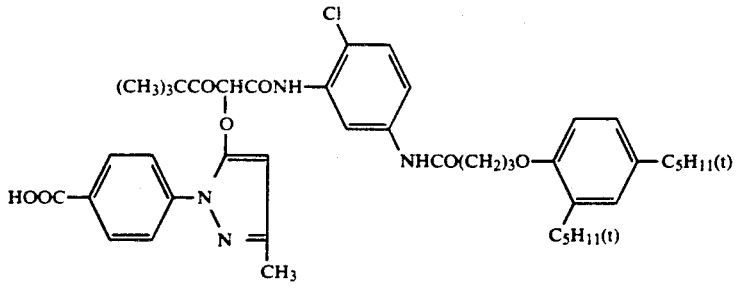
DSR-33
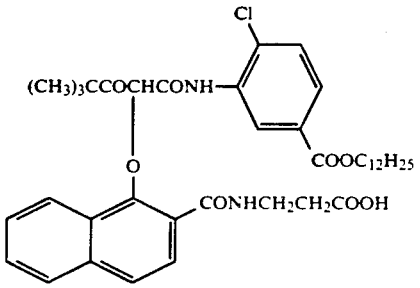
DSR-34
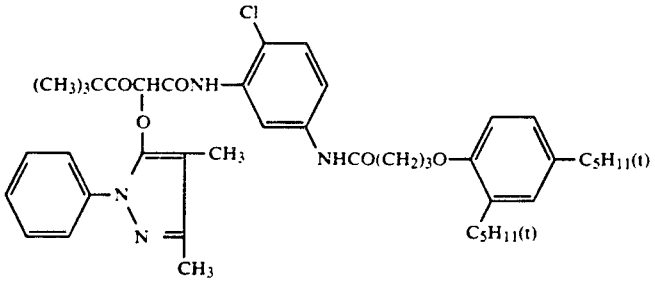
DSR-35
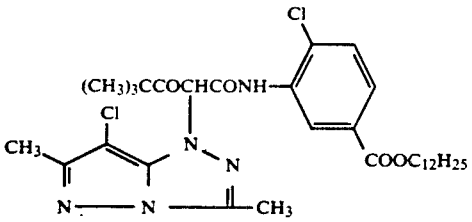
DSR-36
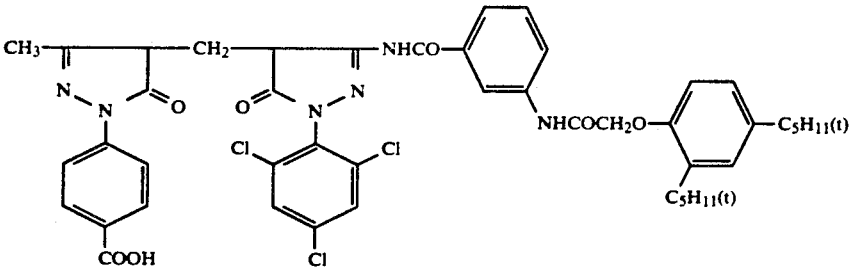

-continued
DSR-37
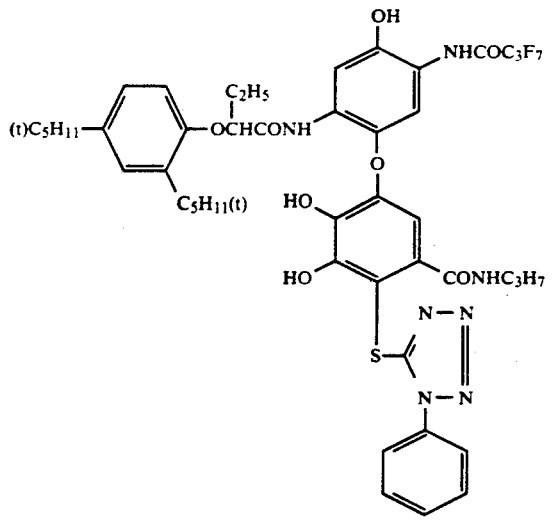
DSR-38
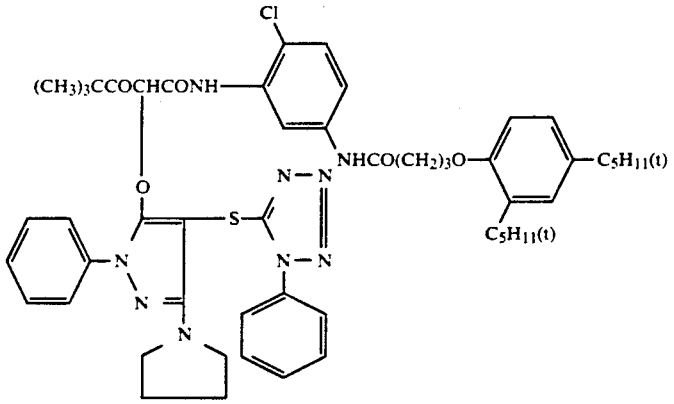
DSR-39
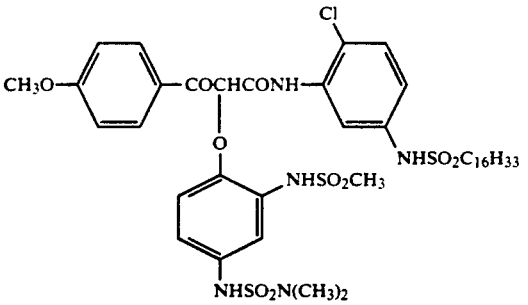
DSR-40
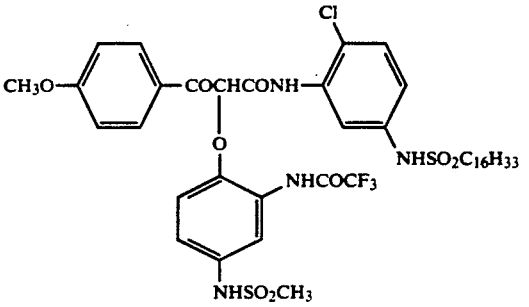

-continued

DSR-41

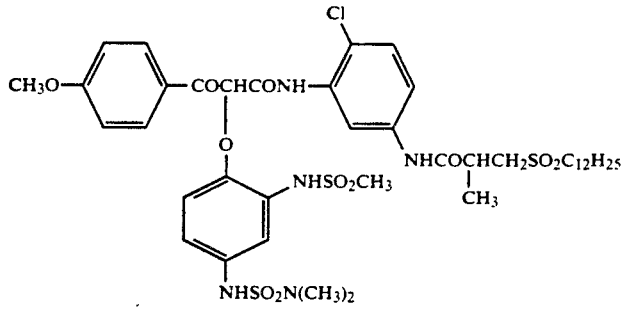

DSR-42

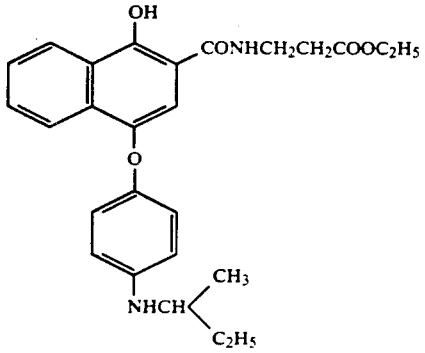

DSR-43

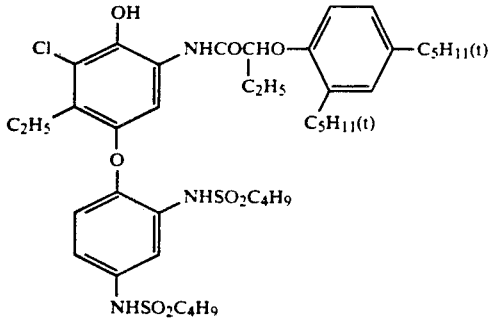

The DSR compounds of the present invention may be incorporated in a light-sensitive silver halide emulsion layer and/or a nonlight-sensitive photographic layer but they are preferably incorporated in a light-sensitive silver halide emulsion layer.

The DSR compounds of the present invention may be incorporated as admixtures in one layer or the same DSR compound may be incorporated in two or more layers.

The DSR compounds of the present invention are preferably contained in amounts ranging from $1\times10^{-2}$ to $8\times10^{-1}$ moles per mole of the coupler in an emulsion layer, with the range of from $2\times10^{-2}$ to $4\times10^{-1}$ moles being more preferred.

The DSR compounds of the present invention can be incorporated into a silver halide emulsion or coating solutions for other photographic layers by various methods. If the DSR compounds are alkalisoluble, they may be added as alkaline solutions. If they are oil-soluble, the methods described in U.S. Pat. Nos. 2,322,027, 2,801,170, 2,801,171, 2,272,191, 2,304,940, etc. are preferably used, according to which the DSR compounds are dissolved in high-boiling point solvents, optionally in combination with low-boiling point solvents, and then dispersed in a fine particulate form to be incorporated in a silver halide emulsion. The DSR compounds can be synthesized by the methods described in JP-A-57-138638, 57-155537, 57-171334, 58-11941, 61-53643, 61-84646, 61-86751, 61-102646, 61-102647, 61-107245, 61-113060, etc.

During development, compounds capable of coupling reaction or redox reaction with the oxidized developing agent or precursors thereof are released from the DSR compounds of the present invention as a function of image density. The released compounds or precursors thereof provide two image effects; in the light-sensitive emulsion layer in which the DSR compound is incorporated, the released compounds or precursors thereof provide an "intra-image" effect such as improvement in image sharpness by controlling the reaction of dye formation (coupling reaction) as a function of image density, and in other layers into which said released compounds or precursors thereof diffuse, they provide an "inter-image" effect such as masking action by inhibiting the reaction of dye formation in those layers as a function of the density of the image in the layer from which they diffuse.

The internal latent image forming silver halide emulsion to be used in the present invention is a silver halide emulsion composed of silver chloride or one that consists of silver chlorobromide or silver chloroidobromide containing at least 50 mol% of AgCl. Preferably, it is a silver halide emulsion containing at least 70 mol% of AgCl, and more preferably, it is a silver halide emulsion containing at least 90 mol% of AgCl.

Particularly preferred effects can be attained if these internal latent image forming silver halide emulsions having a high AgCl content are incorporated together with the DSR compound in the same layer.

Illustrative internal latent image forming silver halide emulsions include: a "conversion" type silver halide emulsion as described in U.S. Pat. No. 2,592,250; a silver halide emulsion having internally chemically sensitized silver halide grains as described in U.S. Pat. Nos. 3,206,316, 3,317,322 and 3,367,778; a silver halide emulsion having polyvalent metal ion containing silver halide grains as described in U.S. Pat. Nos. 3,271,157, 3,447,927 and 3,531,291; a silver halide emulsion in which dopant containing silver halide grains are subjected to weak chemical sensitization as described in U.S. Pat. No. 3,761,276; a "core-shell" type silver halide emulsion as described in JP-A-50-8532, JP-A-50-38525 and JP-A-53-2408; and a silver halide emulsion of the type described in JP-A-52-156614, JP-A-55-127549 and JP-A-57-79940.

Internal latent image forming silver halides formed of multilayered grains are particularly preferred for use in the present invention. Such silver halides can be produced in the same way as in the case of preparing ordinary multi-layered silver halides. Exemplary methods are described in JP-A-50-8524, JP-A-50-38525, JP-A-53-60222, JP-A-55-1524, U.S. Pat. No. 3,206,313, etc.; according to one method, silver chloride grains are first formed and thereafter, a bromide is added to effect conversion to silver bromide grains, followed by addition of a halide and silver nitrate to form multiple layers; according to another method, silver iodobromide grains are formed in the presence of a small amount of excess halogens, and thereafter, silver chloride and silver bromide are successively formed in layers.

Various photographic additives may be incorporated in the internal latent image forming silver halide emulsion to be used in the present invention. For example, spectral sensitizers may be used and they are exemplified by cyanine compounds, merocyanine compounds, 3- or 4-nuclear merocyanine compounds, styryl compounds, holopolar cyanine compounds, hemicyanine compounds, oxonole compounds and hemioxonole compounds.

The internal latent image forming silver halide emulsion used in the present invention may be supersensitized. For the methods of supersensitization, reference may be made to "Review of Supersensitization", Phot. Sci. Eng., 18, p. 4418 (1974).

Stabilizers commonly used to minimize surface sensitivity and to impart lower minimum sensitivity and stabler characteristics may be incorporated in the internal latent image forming silver halide emulsion to be used in the present invention and examples of such stabilizers are compounds having an azaindene ring, as well as heterocyclic compounds having a mercapto group.

A preferred example of the compound having an azaindene ring is 4-hydroxy-6-methyl-1,3,3*a*,7-tetraazaindene. While there are many heterocyclic compounds having a mercapto group, illustrative nitrogenous heterocyclic compounds include pyrazole, triazole, thiadiazole, tetrazole, pyridazine, pyrimidine and triazine rings, as well as compounds having two or three of these rings condensed, such as triazolotriazole, diazaindene, triazaindene, tetrazaindene, pentazaindene, phthalazinone and indazole compounds. Among these compounds, 1-phenyl-5-mercaptotetrazaole is preferred.

Besides DSR compounds, dye-forming couplers may be used in the present invention. Illustrative yellow dye forming couplers include benzoyl acetanilide compounds and pivaloyl acetanilide compounds. Illustrative magenta dye forming couplers include 5-pyrazolone compounds, pyrazoloazole compounds, pyrazolinobenzimidazole compounds, and indazolone compounds. Illustrative cyan dye forming couplers include phenolic compounds, naphtholic compounds and pyrazoloquinozolone compounds. Two-equivalent couplers having a "split-off" group on the carbon atom at the coupling site of these couplers may also be used with preference.

Any suitable coupler can be selected from among the dye forming couplers listed above and there is no limitation on the method of their use, the amount in which they are used, and other factors.

Ultraviolet absorbers can be used to prevent color fading that would otherwise occur in dye images upon exposure to actinic radiation of short wavelengths. Exemplary uv absorbers include thiazolidone, benzotriazole, acrylonitrile and benzophenone compounds, and particularly advantageous examples are Tinuvin PS, 120, 320, 326, 327 and 328 (all being available from Ciba Geigy A.G.), which may be used either alone or in combination.

Constituent layers of the photographic material of the present invention may be hardened with a suitable hardener. Exemplary hardeners include halotriazine compounds, polyepoxy compounds, ethyleneimine compounds, vinylsulfone compounds and acryloyl compounds.

In addition to light-sensitive emulsion layers containing internal latent image forming silver halide grains, the photographic material of the present invention may have various photographic layers formed on a support as required and examples of such optional constituent layers include a filter layer, an intermediate layer, a protective layer, a subbing layer, a backing layer, an anti-halo layer, etc.

The principal steps of forming a direct positive image in the internal latent image forming photographic material of the present invention comprise imagewise exposure of the photographic material having a yet to be fogged internal latent image forming silver halide emulsion layer, a fogging treatment (i.e., forming fog specks by either chemical or optical action), followed by or accompanied with surface development. Fogging treatment can be performed either by full-frame exposure or with a foggant (i.g., a compound capable of forming fog specks).

In the present invention, full-frame exposure can be performed by subjecting the imagewise exposed light-sensitive material to uniform overall exposure after it is immersed or swollen in a developer or other aqueous solutions. Any exposing light source can be used as long as it emits light at wavelengths within the spectral sensitivity range of the photographic material. High-illuminance light such as flash light may be applied for a short period of time, or alternatively, weak light may be applied for a prolonged time. The time of full-frame exposure can be varied over a broad range depending on such factors as the type of photographic material, development conditions and the type of light source used and the only requirement that should be satisfied is that the eventually obtained positive image have best quality.

Primary aromatic amino color developing agents are used in color developing the photographic material of the present invention and they may be selected from known compounds that are used extensively in various color photographic processes. Aminophenol and p-phenylenediamine derivatives are commonly used and they are ordinarily used in the form of salts, such as hydrochlorides, sulfates and sulfites, which are stabler than when they are in the free state.

Particularly useful primary aromatic amino color developing agents are N,N-dialkyl-p-phenylenediamine compounds, and the alkyl and phenylene groups may or may not have substituents. Particularly useful compounds include N,N-diethyl-p-phenylenediamine hydrochloride, N-methyl-p-phenylenediamine hydrochloride, 2-amino-5-(N-ethyl-N-dodecylamino)toluene, N-ethyl-N-α-methanesulfonamidoethyl-3-methyl-4-aminoaniline sulfate, N-ethyl-N-α-hydroxyethylaminoaniline, 4-amino-3-methyl-N,N-diethylaniline, N-ethyl-N-≢-methoxyethyl-3-methyl-4-aminoaniline and p-toluene sulfonate.

These compounds are generally used at concentrations of 0.1-30 g, preferably 1-15 g, per liter of the color developer.

Also, hydroxylamine salt compounds and sulfite compounds can be incorporated in color developer. The hydroxylmine salt compounds are incorporated at concentrations of preferably no more than 2 g, more preferably no more than 1 g, per liter of the color developer in terms of amounts of sulfate. The sulfite compounds are incorporated at concentrations of preferably no more than 0.01 mole, more preferably no more than 0.003 mole, per liter of the color developer. Further, bromide ion is incorporated at concentrations of preferably no more than $5\times10^{-3}$ mole, more preferably $2\times10^{-3}$ mole, per liter of the color developer.

Hydroxylamine compounds represented by the following general formula [A] may be preferably incorporated in the color developer to be used in the present invention:

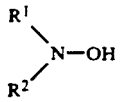

[A]

where $R^1$ and $R^2$ each represents a substituted or unsubstituted alkyl group or hydrogen atom, provided that $R^2$ and $R^2$ cannot be hydrogen atom at the same time, and may form a ring by combining each other.

The abovementioned hydroxylamine compounds are incorporated at concentrations of preferably within the range of 1-15 g, more preferably 2-10 g, per liter of the color developer in terms of amounts of sulfate.

The hydroxylamines are commonly used in the form of salts, such as hydrochlorides, sulfates, p-toluensulfonates, oxalates, phosphates and acetates, or free amines.

The following are non-limiting examples of the hydroxylamine compounds represented by the general formula [A].

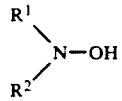

| Compound | $R^1$ | $R^2$ |
|---|---|---|
| A-1 | $-C_2H_5$ | $-C_2H_5$ |
| A-2 | $-CH_3$ | $-CH_3$ |
| A-3 | $-C_3H_7$ | $-C_3H_7$ |
| A-4 | $-C_3H_7$(l) | $-C_3H_7$(i) |
| A-5 | $-CH_3$ | $-C_2H_5$ |
| A-6 | $-C_2H_5$ | $-C_3H_7$(i) |
| A-7 | $-CH_3$ | $-C_3H_7$(i) |
| A-8 | $-H$ | $-C_2H_5$ |
| A-9 | $-H$ | $-C_3H_7$ |
| A-10 | $-H$ | $-CH_3$ |
| A-11 | $-H$ | $-C_3H_7$(i) |
| A-12 | $-C_2H_5$ | $-C_2H_4OCH_3$ |
| A-13 | $-C_2H_4OH$ | $-C_2H_4OH$ |
| A-14 | $-C_2H_4SO_3H$ | $-C_2H_5$ |
| A-15 | $-C_2H_4COOH$ | $-C_2H_4COOH$ |
| A-16 | 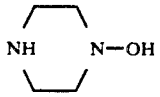 | |
| A-17 | 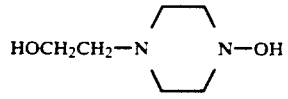 | |
| A-18 | 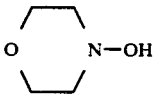 | |
| A-19 | 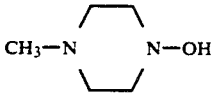 | |
| A-20 | $-CH_3$ | $-C_2H_4OCH_3$ |
| A-21 | $-C_2H_4OCH_3$ | $-C_2H_4OCH_3$ |
| A-22 | $-O_2H_4OC_2H_5$ | $-O_2H_4OC_2H_5$ |
| A-23 | $-C_3H_6OCH_3$ | $-C_2H_6OCH_3$ |
| A-24 | $-C_2H_5$ | $-O_2H_4OC_2H_5$ |
| A-25 | $-C_3H_7$ | $-C_2H_4OCH_3$ |
| A-26 | $-CH_3$ | $-O_2H_4OC_2H_5$ |
| A-27 | $-CH_3$ | $-CH_2OCH_3$ |
| A-28 | $-C_2H_5$ | $-CH_2OC_2H_5$ |
| A-29 | $-CH_2OCH_3$ | $-CH_2OCH_3$ |
| A-30 | $-C_2H_5$ | $-C_2H_4OC_3H_7$ |
| A-31 | $-C_3H_6OC_3H_7$ | $-C_3H_6OC_3H_7$ |

The time for which the direct positive color light-sensitive material of the present invention is color developed is not limited to any particular value but from the viewpoint of rapid processing, color development is completed preferably within 2 minutes, more preferably within 1.5 minutes.

The following examples are provided for the purpose of further illustrating the present invention but are in no way to be taken as limiting.

EXAMPLE 1

1) Preparation of Emulsions

Comparative emulsions S were prepared by the following procedure. An aqueous solution of silver nitrate and an aqueous solution of potassium bromide were added simultaneously in equimolar amounts to an aqueous gelatin solution at 50° C. over a period of about 50 min by the double-jet method to prepare an emulsion comprising cubic silver bromide grains having an average particle size of 0.18 μm. To this emulsion, an aqueous solution of silver nitrate and an aqueous solution of a mixture of sodium chloride and potassium bromide (molar ratio 1:1) were added simultaneously to prepare a cubic core/shell S emulsion (EM-1) having an average particle size of 0.27 μm and which was composed of a silver bromide core and a silver chlorobromide shell.

In a similar manner, a core/shell M emulsion (EM-2) having an average particle size of 0.45 μm and which consisted of a silver bromide core (0.3 μm) and a silver chlorobromide shell (molar ratio 1:1) and a core/shell L emulsion (EM-3) having an average particle size of 0.75 μm and which consisted of a silver bromide core (0.5 μm) and a silver chlorobromide shell (molar ratio 1:1) were prepared.

2) Preparation of Emulsions

Emulsions to be used in the present invention were prepared by the following procedure. An aqueous solution of silver nitrate and an aqueous solution of potassium bromide were added simultaneously in equimolar amounts to an aqueous gelatin solution at 50° C. over a period of about 50 min by the double-jet method to prepare an emulsion comprising cubic silver bromide grains having an average particle size of 0.12 μm. To this emulsion, an aqueous solution of silver nitrate and an aqueous solution of sodium chloride were added simultaneously to prepare a cubic core/shell S emulsion (EM-4) having an average particle size of 0.27 μm and which was composed of a silver bromide core and a silver chloride shell.

In a similar way, a core/shell M emulsion (EM-5) having an average particle size of 0.45 μm and which consisted of a silver bromide core (0.2 μm) and a silver chloride shell and a core/shell L emulsion (EM-6) having an average particle size of 0.75 μm and which consisted of a silver bromide core (0.333 μm) and a silver chloride shell were prepared.

3) Preparation of Emulsions

Additional emulsions to be used in the present invention were prepared by the following procedure. An aqueous solution of silver nitrate and an aqueous solution of a mixture of potassium bromide and sodium chloride (molar ratio 2:1) were added simultaneously in equimolar amounts to an aqueous gelatin solution at 50° C. over a period of about 50 min by the double-jet method to prepare an emulsion comprising cubic silver chlorobromide grains having an average particle size of 0.18 μm. To this emulsion, an aqueous solution of silver nitrate and an aqueous solution of sodium chloride were added simultaneously to prepare a cubic core/shell S emulsion (EM-7) having an average particle size of 0.27 μm and which was composed of a silver chlorobromide core and a silver chloride shell.

In a similar way, a core/shell M emulsion (EM-8) having an average particle size of 0.45 μm and which consisted of a silver chlorobromide core (0.3 μm; molar ratio 2:1) and a silver chloride shell, and a core/shell L emulsion (EM-9) having an average particle size of 0.75 μm and which consisted of a silver chlorobromide core (0.5 μm; molar ratio 2:1) and a silver chloride shell were prepared.

The compositions of emulsions EM-1 to EM-9 thus prepared are summarized in Table 1 below.

TABLE 1

| | Particle size, μm | | Br:Cl ratio | | AgCl/AgBrCl |
|---|---|---|---|---|---|
| | Core | Core/shell | Core | shell | (%) |
| EM-1 | 0.18 | 0.27 | 100:0 | 1:1 | 35.6 |
| EM-2 | 0.30 | 0.45 | 100:0 | 1:1 | 35.6 |
| EM-3 | 0.50 | 0.45 | 100:0 | 1:1 | 35.6 |
| EM-4 | 0.12 | 0.27 | 100:0 | 0:100 | 92.1 |
| EM-5 | 0.2 | 0.45 | 100:0 | 0:100 | 92.1 |
| EM-6 | 0.333 | 0.75 | 100:0 | 0:100 | 92.4 |
| EM-7 | 0.18 | 0.27 | 2:1 | 0:100 | 81.4 |
| EM-8 | 0.30 | 0.45 | 2:1 | 0:100 | 81.4 |
| EM-9 | 0.50 | 0.75 | 2:1 | 0:100 | 81.4 |

Paper bases 140 μm thick that were coated with polyethylene on both sides were coated with emulsion layers, non-emulsion layers and a backing layer according to the compositions shown in Table 2. The amounts of additives incorporated are indicated in Table 2 in terms of mg/dm$^2$, except that the amounts of silver halide emulsions and yellow colloidal silver deposited are calculated for silver.

TABLE 2

| Layer | Composition | Amount |
|---|---|---|
| Eighth layer (uv absorber layer) | uv absorber (UV-1) | 0.65 |
| | uv absorber (UV-2) | 1.95 |
| | Solvent (SO-3) | 1.0 |
| | Colloidal silica | 0.07 |
| | Gelatin | 7.8 |
| Seventh layer (blue-sensitive layer) | AgBrCl emulsion (r 0.75 μm) (see Table 3) | 4.4 |
| | AgBrCl emulsion (r 0.45 μm) (see Table 3) | 1.2 |
| | Blue sensitizing dye (BD-1) | 0.2* |
| | Yellow coupler (Y-1) | 8.2 |
| | Image stabilizer (AO-3) | 3.0 |
| | Anti-stain agent (AS-1) | 0.25 |
| | Anti-stain agent (AS-2) | 0.25 |
| | Solvent (SO-1) | 5.2 |
| | Restrainers (ST-1, ST-2, ST-4, ST-5, ST-6) | |
| | Gelatin | 14.3 |
| Sixth layer (intermediate layer) | Anti-stain agent (AS-1) | 0.55 |
| | Solvent (SO-2) | 0.72 |
| | Gelatin | 5.4 |
| Fifth layer (colloidal silver layer) | Yellow colloidal silver | 1.05 |
| | Anti-stain agent (AS-1) | 0.40 |
| | Solvent (SO-2) | 0.49 |
| | Polyvinylpyrrolidone | 0.47 |
| | Gelatin | 9.2 |
| Fourth layer (intermediate layer) | Anti-stain agent (AS-1) | 0.55 |
| | Solvent (SO-2) | 0.72 |
| | Gelatin | 5.4 |
| Third layer (green-sensitive layer) | AgBrCl emulsion (r 0.45 μm) (see Table 3) | 1.30 |
| | AgBrCl emulsion (r 0.27 μm) (see Table 3) | 2.0 |
| | Green sensitizing dye (GD-1) | 0.09* |
| | Magenta coupler (M-1) | 2.4 |
| | Image stabilizer (AO-1) | 2.2 |
| | Image stabilizer (AO-2) | 1.25 |
| | Anti-stain agent (AS-1) | 0.03 |
| | Anti-stain agent (AS-2) | 0.19 |
| | Solvent (SO-4) | 3.15 |
| | Anti-irradiation dye (AI-1) | 0.13 |
| | Restrainers (ST-1, ST-2, ST-3, ST-4, ST-5, ST-6) | |
| | Gelatin | 13.0 |
| Second layer (intermediate layer) | Anti-stain agent (AS-1) | 0.55 |
| | Solvent (SO-2) | 0.72 |
| | Gelatin | 7.5 |
| First layer (red-sensitive layer) | AgBrCl emulsion (r 0.45 μm) (see Table 3) | 2.08 |
| | AgBrCl emulsion (r 0.27 μm) (see Table 3) | 0.70 |
| | Red sensitizing dye (RD-1) | 0.06* |
| | Red sensitizing dye (RD-2) | 0.06* |
| | Cyan coupler (C-1) | 2.08 |
| First layer (red- | Cyan coupler (C-2) | 2.08 |

TABLE 2-continued

| Layer | Composition | Amount |
|---|---|---|
| sensitive layer) | DSR compound (see Table 3) | (see Table 3) |
| | Image stabilizer (AO-3) | 2.2 |
| | Anti-stain agent (AS-2) | 0.15 |
| | Solvent (SO-1) | 3.3 |
| | Anti-irradiation dye (AI-2) | 0.09 |
| | Restrainers (ST-1, ST-2, ST-3, ST-4, ST-5, ST-6) | |
| | Gelatin | 13.8 |
| Base support | Polyethylene coated paper | |
| Backing layer | Colloidal silica | 6.0 |

TABLE 2-continued

| Layer | Composition | Amount |
|---|---|---|
| | Gelatin | 5.3 |

*mg/mol AgX

Surfactants SA-1 and SA-2 were used as coating aids for the emulsion layers and the backing layer. Compounds H-1 and H-2 were used as hardeners.

Nineteen samples of photographic material were prepared on the basis of the compositions shown in Table 2, except that the DSR compound incorporated in the first layer was changed as shown in Table 3 to be given hereinafter.

Additives used

RD-1

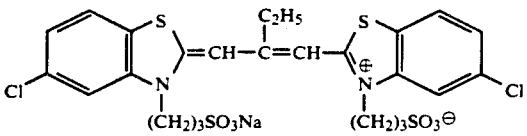

RD-2

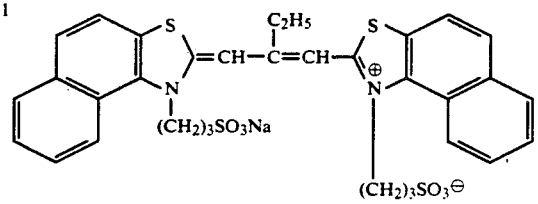

GD-1

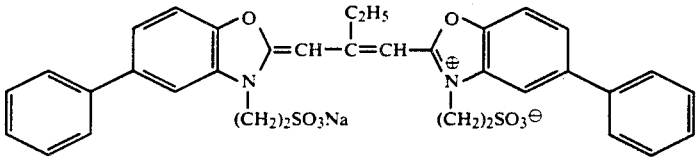

BD-1

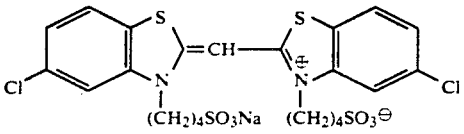

C-1

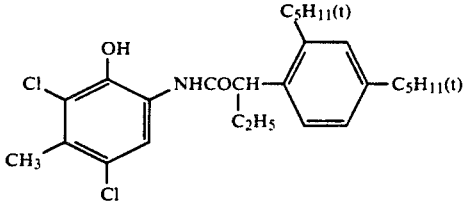

C-2

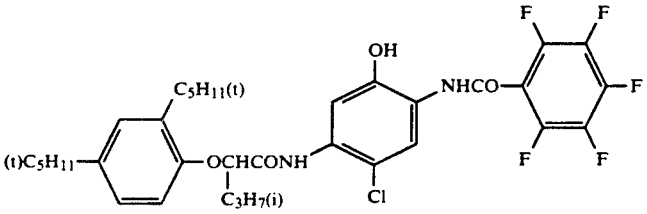

M-1

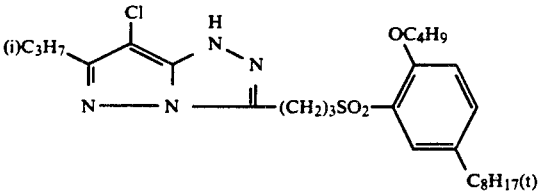

Y-1

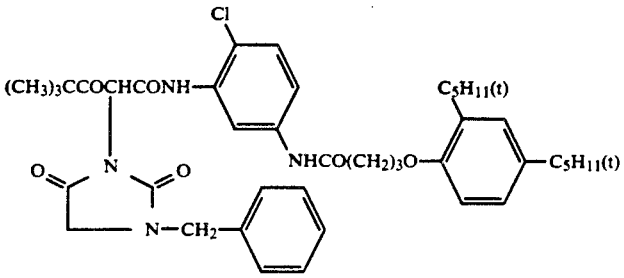

-continued
Additives used
SO-1
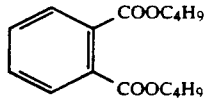
SO-2
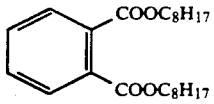
SO-3
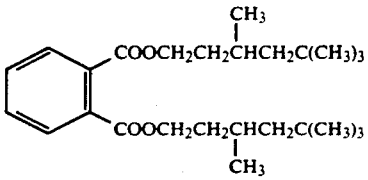
SO-4
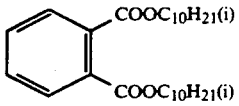
AS-1
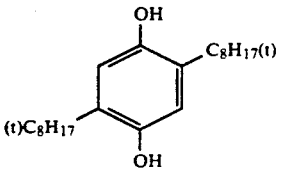
AS-2
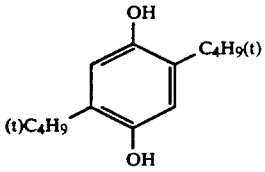
AO-1
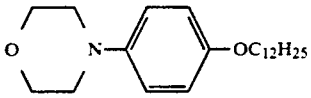
AO-2
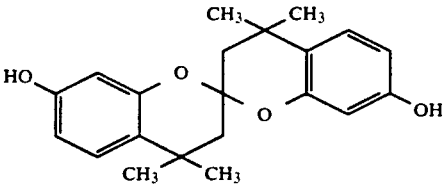
AO-3
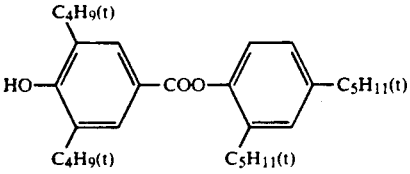
ST-1
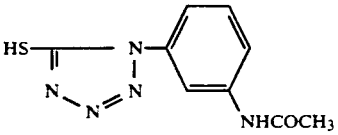
ST-2
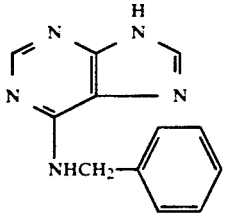
ST-3
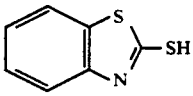
ST-4
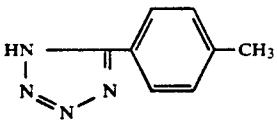
ST-5
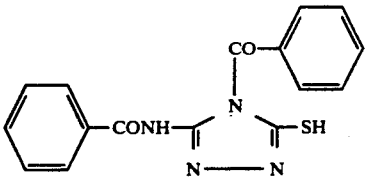
ST-6
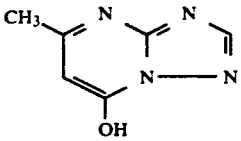
H-1
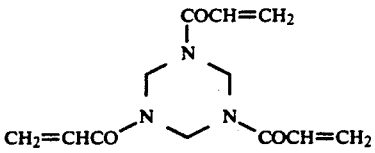
H-2
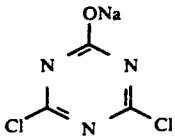
UV-1
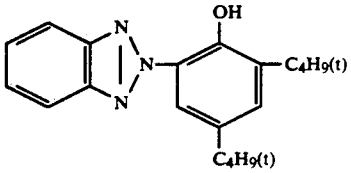

-continued

Additives used

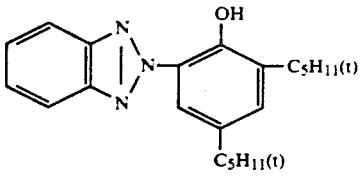

UV-2

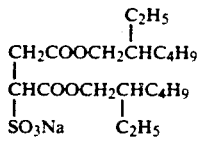

SA-1

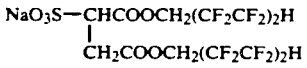

SA-2

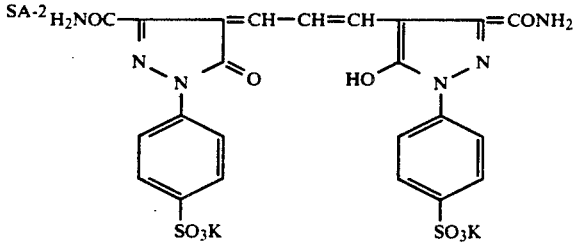

AI-1

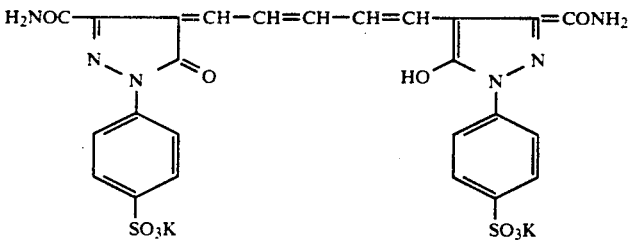

AI-2

The light-sensitive materials thus prepared were exposed to red light through an optical wedge and subsequently processed according to the scheme shown below.

| Steps | Temperature, °C. | Time |
|---|---|---|
| 1. Immersion in color developer | 35 | 8 sec |
| 2. Fogging exposure | — | 10 sec at 1 lux |
| 3. Color development | 35 | 1 min |
| 4. Bleach-fixing | 35 | 60 sec |
| 5. Stabilizing | 25-30 | 1 min and 30 sec |
| 6. Drying | 75-80 | 1 min |

Formulas of processing solution

| | |
|---|---|
| Color developer | |
| Triethanolamine | 8 g |
| N,N-Diethylhydroxylamine | 5 g |
| Potassium chloride | 2 g |
| N-Ethyl-N-β-methanesulfonamidoethyl-3-methyl-4-aminoaniline sulfate | 5 g |
| Sodium tetrapolyphosphate | 2 g |
| Potassium carbonate | 30 g |
| Potassium sulfite | 0.2 g |
| Brightener (4,4'-diaminostilbene disulfonic acid derivative) | 1 g |
| Water | to make 1,000 ml |
| pH adjusted to 10.20 | |
| Bleach-fixing solution | |
| Ethylenediaminetetraacetic acid iron (III) ammonium dihydrate | 60 g |
| Ethylenediaminetetraacetic acid | 3 g |
| Ammonium thiosulfate (70% aq. sol.) | 100 ml |
| Ammonium sulfite (40% aq. sol.) | 27.5 ml |
| Water | to make 1,000 ml |
| pH adjusted to 7.1 with potassium carbonate or glacialacetic acid | |

-continued

| | |
|---|---|
| Stabilizing solution | |
| 5-Chloro-2-methyl-4-isothiazolin-3-one | 1.0 g |
| Ethylene glycol | 10 g |
| 1-Hydroxyethylidene-1,1-diphosphonic acid | 2.5 g |
| Bismuth chloride | 0.2 g |
| Magnesium chloride | 0.1 g |
| Ammonium hydroxide (28% aq. sol.) | 2.0 g |
| Sodium nitrilotriacetate | 1.0 g |
| Water | to make 1,000 ml |
| pH adjusted to 7.0 with ammonium hydroxide or sulfuric acid. | |

The stabilizing treatment was performed by a countercurrent method in two tanks.

The spectral absorptions of reflected light from the processed samples were measured with a spectrophotometer (Model 320 of Hitachi, Ltd.) equipped with an integrating sphere. The absorbance at λmax of spectral absorption was adjusted to A max = 1.3±0.05, and the wavelength at which an absorbance of A = A max/2 was obtained in the tail portion on the shorter wavelength side was measured as λs.

Figure 2:
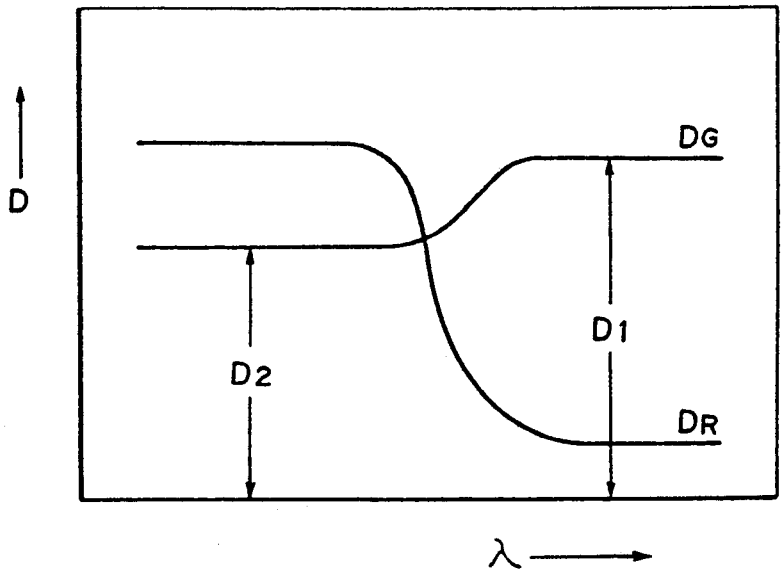
FIG. 2 is a graph showing characteristic curves obtained by developing the direct positive color photographic material of the present invention.

Density measurements were also conducted on the samples with green and red light and characteristic curves $D_G$ (showing density by measurements with green light) and $D_R$ (showing density by measurements with red light) were obtained as shown in FIG. 2. The $D_G$ value ($D_1$) at the minimum density on $D_R$ and the $D_G$ value ($D_2$) at the maximum density on $D_R$ were measured and $\Delta D = D_1 - D_2$ was determined. The greater the ΔD, the greater the inter-image effect that could be attained. The overall results are shown in Table 3.

TABLE 3

| Sample No. | Emulsion: Blue-sensitive layer | Emulsion: Green-sensitive layer | Emulsion: Red-sensitive layer | DSR compound: Type | DSR compound: Amount* | λs | ΔD |
|---|---|---|---|---|---|---|---|
| 1. (Comparison) | EM-3, EM-2 | EM-2, EM-1 | EM-2, EM-1 | — | — | 543 | −0.156 |
| 2. (Comparison) | " | " | " | DSR-23 | 3 | 544 | −0.075 |
| 3. (Comparison) | " | " | " | DSR-43 | 3 | 543 | −0.100 |
| 4. (Sample of the Invention) | EM-6, EM-5 | EM-5, EM-4 | EM-5, EM-4 | DSR-6 | 3 | 544 | 0.120 |
| 5. (Sample of the Invention) | " | " | " | DSR-12 | 3 | 545 | 0.123 |
| 6. (Sample of the Invention) | " | " | " | DSR-14 | 3 | 543 | 0.110 |
| 7. (Sample of the Invention) | " | " | " | DSR-23 | 3 | 544 | 0.130 |
| 8. (Sample of the Invention) | " | " | " | " | 15 | 548 | 0.175 |
| 9. (Sample of the Invention) | " | " | " | DSR-24 | 3 | 544 | 0.110 |
| 10. (Sample of the Invention) | " | " | " | DSR-43 | 3 | 543 | 0.125 |
| 11. (Sample of the Invention) | " | " | " | " | 15 | 549 | 0.168 |
| 12. (Sample of the Invention) | EM-9, EM-8 | EM-8, EM-7 | EM-8, EM-7 | DSR-6 | 3 | 544 | 0.093 |
| 13. (Sample of the Invention) | " | " | " | DSR-12 | 3 | 545 | 0.097 |
| 14. (Sample of the Invention) | " | " | " | DSR-14 | 3 | 543 | 0.088 |
| 15. (Sample of the Invention) | " | " | " | DSR-23 | 3 | 544 | 0.100 |
| 16. (Sample of the Invention) | " | " | " | " | 15 | 548 | 0.140 |
| 17. (Sample of the Invention) | " | " | " | DSR-24 | 3 | 544 | 0.088 |
| 18. (Sample of the Invention) | " | " | " | DSR-43 | 3 | 543 | 0.098 |
| 19. (Sample of the Invention) | " | " | " | " | 15 | 549 | 0.135 |

*mol % per mole of coupler

As is clear from Table 3, the direct positive color photographic samples of the present invention contained DSR compounds in smaller amounts than the comparative samples and yet they did not experience any change in image color, indicating the great interimage they produced.

EXAMPLE 2

Sample Nos. 20–37 were prepared by repeating the procedures of Example 1 except that the coating solutions of red-sensitive layer were left to stand at 40° C. for 4 h after their preparation. Sample Nos. 1–19 that were prepared in Example 1 and which were not left to stand at all (digestion time, 0 h) were used as reference samples. The results are shown in Table 4, in which gamma (γ) represents the gradient of the straight line connecting the point of $D_R$ min+0.3 and the point of $D_R$ min+1.0 on the characteristic curve, with $D_R$ min being the minimum density by red light, and $\Delta\gamma=\gamma_1-\gamma_2$, where γ at zero digestion time; $\gamma_2$, γ after 4 h of digestion.

TABLE 4

| Sample No. | Δγ |
|---|---|
| 20 (sample No. 1 digested for 4 h) | 0.060 |
| 21 (sample No. 2 digested for 4 h) | 0.150 |
| 22 (sample No. 2' digested for 4 h) | 0.211 |
| 23 (sample No. 3 digested for 4 h) | 0.340 |
| 24 (sample No. 3' digested for 4 h) | 0.710 |
| 25 (sample No. 4 digested for 4 h) | 0.058 |
| 26 (sample No. 5 digested for 4 h) | 0.050 |
| 27 (sample No. 6 digested for 4 h) | 0.065 |
| 28 (sample No. 7 digested for 4 h) | 0.043 |
| 29 (sample No. 8 digested for 4 h) | 0.105 |
| 30 (sample No. 9 digested for 4 h) | 0.090 |
| 31 (sample No. 10 digested for 4 h) | 0.104 |
| 32 (sample No. 12 digested for 4 h) | 0.079 |
| 33 (sample No. 13 digested for 4 h) | 0.097 |
| 34 (sample No. 14 digested for 4 h) | 0.095 |
| 35 (sample No. 15 digested for 4 h) | 0.065 |
| 36 (sample No. 16 digested for 4 h) | 0.131 |
| 37 (sample No. 17 digested for 4 h) | 0.095 |

Sample Nos. 2' and 3' were prepared in the same manner as the preparation of Sample Nos 2 and 3 in Example 1, respectively, except that amount added of DSR compounds was changed from 3 mole % per mole of coupler to 20 mole % per mole of coupler.

As Table 4 shows, the direct positive color photographic materials of the present invention experience very small changes in γ even if the coating solutions are not applied immediately after their preparation.

What is claimed is:

1. A method of forming a photographic image, said method comprising developing an internal latent image forming direct positive silver halide color photographic material comprising blue-sensitive, green-sensitive, and red-sensitive direct positive silver halide emulsion layers, wherein at least one of said emulsion layers contains both (1) silver chloride or a silver halide composed of silver chlorobromide or silver chloroiodobromide containing at least 50 mol % of AgCl, and (2) a compound represented by the following general formula (I):

$$\text{Coup}-(\text{Time})_l-\text{Sc} \qquad \text{(I)}$$

where Coup is a coupler residue capable of releasing $(\text{Time})_l-\text{Sc}$ upon reaction with the oxidation product of a color developing agent; Time is a timing group capable of releasing Sc after Time-Sc is released from Coup; Sc is a scavenger of the oxidation product of the color developing agent which is capable of scavenging said oxidation product by a redox reaction or a coupling reaction; and l is 0 or 1, said method comprising imagewise exposing said material, fogging the exposed material, surface developing said material simultaneously with or subsequent to said fogging, and bleach fixing said material, surface developing being conducted with a color developer containing at least one hydroxylamine compound represented by the following general formula [A]:

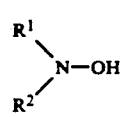

[A]

where $R^1$ and $R^2$ each represents a substituted or unsubstituted alkyl group or hydrogen atom, provided that $R^1$ and $R^2$ both cannot be a hydrogen atom at the same time, and may form a ring by combining with each other.

2. The method according to claim 1 wherein the coupler residue represented by Coup in the general formula (I) is represented by either one of the following general formulas (Ia) to (Ih):

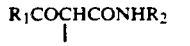
(Ia)

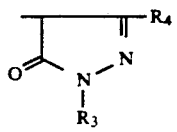
(Ib)

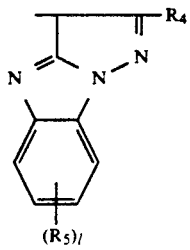
(Ic)

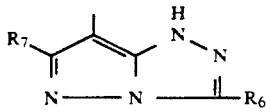
(Id)

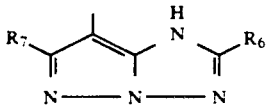
(Ie)

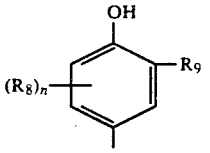
(If)

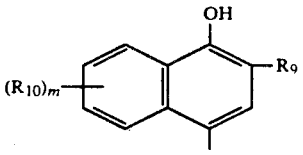
(Ig)

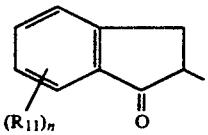
(Ih)

where $R_1$ represents an alkyl, aryl or arylamino group; $R_2$ represents an aryl or alkyl group;

$R_3$ represents an alkyl or aryl group; $R_4$ represents an alkyl, acylamino, arylamino, arylureido or alkylureido group;

$R_5$ represents an acylamino group, a sulfonamide group, an alkyl group, an alkoxy group or a halogen atom;

$R_7$ represents an alkyl, aryl, acylamino, arylamino, alkoxy, arylureido or alkylureido group; $R_6$ represents an alkyl or aryl group;

$R_9$ is an acylamino, carbamoyl or arylureido group; $R_8$ represents a halogen atom or an alkyl, alkoxy, acylamino or sulfonamido group;

$R_{10}$ represents an amino, carbonylamido, sulfonamido or hydroxyl group;

$R_{11}$ represents a nitro group, an acylamino group, a succinimido group, a sulfonamido group, an alkoxy group, an alkyl group, a halogen atom or a cyano group;

l represents an integer of 0–3; n represents an integer of 0–2; m represents an integer of 0 or 1, provided that when l and n are each 2 or more, $R_5$, $R_8$ and $R_{11}$ may be the same or different.

3. The method according to claim 2 wherein the sum of carbon atoms in the groups represented by $R_1$–$R_{11}$ in each of the general formulas (Ia) to (Ih) is 15–30.

4. The method according to claim 2 wherein the sum of carbon atoms in the groups represented by $R_1$–$R_{11}$ in each of the general formulas (Ia) to (Ih) is no more than 15.

5. The method according to claim 2 wherein the coupler residue represented by Coup in the general formula (I) is a coupler residue substantially incapable of forming an image forming color dye.

6. The method according to claim 5 wherein said coupler residue substantially incapable of forming an image forming color dye is a releasable dye forming coupler residue wherein the sum of carbon atoms in the groups represented by $R_1$–$R_{10}$ in each of the general formulas (Ia) to (Ih) is no more than 15.

7. The method according to claim 6 wherein said releasable dye forming coupler residue has at, least one substituent in either one of $R_1$–$R_{11}$ which is selected from the group consisting of a carboxyl group, an arylsulfonamido group and an alkylsulfonamide group.

8. The method according to claim 1 wherein the timing group represented by Time in the general formula (I) is represented by one of the following general formulas (Ii), (Ij) and (Ik):

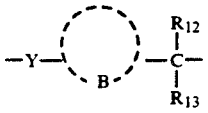
(Ii)

where B is the atomic group necessary to complete a benzene or naphthalene ring; Y represents

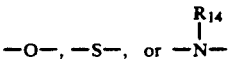

which are bound to the active site of Coup in the general formula (I); $R_{12}$, $R_{13}$ and $R_{14}$ each represents a hydrogen atom, an alkyl group or an aryl group; and and

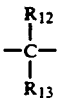

is a group substituted in the position ortho or para to Y and is connected at the other end to Sc in the general formula (I);

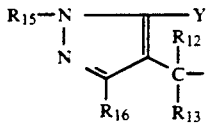

(Ij)

where Y, $R_{12}$ and $R_{13}$ has the same meaning as in the general formula (Ii); $R_{15}$ is a hydrogen atom, an alkyl group, an aryl group, an acyl group, a sulfonyl group, an alkoxycarbonyl group or a heterocyclic residue; $R_{16}$ is a hydrogen atom, a heterocyclic residue, an alkyl, aryl, alkoxy, amino, acid amido, sulfonamido, carboxyl, alkoxycarbonyl, carbamoyl or cyano group; and as in the general formula (Ii), the timing group in the general formula (Ij) has Y bound to the active site of Coup in the general formula (I) and has

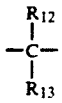

bound to Sc;

—Nu—D—E— (Ik)

where Nu represents an electron-rich nucleophilic group which is bound to the active site of Coup in the general formula (I); E represents an electron-deficient electrophilic group which is bound to the hetero atom in Sc; and D represents a bonding group that relates Nu sterically to E and which, after Nu is released from Coup, undergoes a reaction accompanied by the formation of a 3- to 7-membered ring to destroy the intramolecular nucleophilic substitution, thereby releasing Sc.

9. The method according to claim 1 wherein the scavenger represented by Sc in the general formula (I) is of a redox type.

10. The method according to claim 1 wherein the sum of carbon atoms in Sc is 6–50.

11. The method according to claim 1 wherein the sum of carbon atoms in Sc is 6–30.

12. The method according to claim 1 wherein the compound represented by the general formula (I) is contained in a silver halide emulsion layer in an amount of $1\times10^{-2}$ to $8\times10^{-1}$ moles per mole of the coupler in said emulsion layer.

13. The method according to claim 1 wherein the compound represented by the general formula (I) is contained in a silver halide emulsion layer in an amount of $2\times10^{-2}$ to $4\times10^{-1}$ mole per mole of the coupler in said emulsion layer.

14. The method according to claim 1 wherein the silver halide emulsion made of silver halide is an internal latent image forming emulsion.

15. The method according to claim 14 wherein said internal latent image forming emulsion is made of multilayered grains.

16. The method according to claim 1 wherein said silver halide is silver chloride or composed of silver chlorobromide or silver chloroiodobromide containing at least 70 mol% of AgCl.

17. The method according to claim 1 wherein said silver halide is silver chloride or composed of silver chlorobromide or silver chloroiodobromide containing at least 90 mol% of AgCl.

18. The method according to claim 1 wherein said silver halide and the compound represented by the general formula (I) are contained in the same layer.

19. The method according to claim 1 which further contains a compound having an azaindene ring and a heterocyclic compound having a mercapto group.

20. The method according to claim 1 which further contains an ultraviolet absorber.

21. The method according to claim 1 wherein the photographic material is color developed for no more than 1.5 minutes.

* * * * *